United States Patent [19]

Largman et al.

[11] 4,402,917

[45] Sep. 6, 1983

[54] EXTRACTION OF URANIUM FROM PHOSPHORIC ACID USING SUPPORTED EXTRACTANTS

[75] Inventors: Theodore Largman, Morristown; Stylianos Sifniades, Madison, both of N.J.

[73] Assignee: Allied Chemical Corporation, Morris Township, Morris County, N.J.

[21] Appl. No.: 184,589

[22] Filed: Sep. 5, 1980

[51] Int. Cl.[3] ..... C01G 43/00

[52] U.S. Cl. ..... 423/7; 423/10; 210/673; 210/679; 210/504

[58] Field of Search ..... 423/6, 7, 8, 10, DIG. 14; 210/679, 673

[56] References Cited

U.S. PATENT DOCUMENTS

| | | | |
|---|---|---|---|
| 3,320,033 | 5/1967 | Goren | 423/6 |
| 3,531,463 | 9/1970 | Gustafson | 210/673 |
| 3,663,467 | 5/1972 | Albright | 210/502 |
| 3,737,513 | 6/1973 | Wiewiorowski | 423/8 |
| 3,835,214 | 9/1974 | Hurst | 423/10 |
| 3,960,762 | 6/1976 | Kroebel | 423/DIG. 14 |
| 4,220,726 | 9/1980 | Warshawsky | 525/55 |
| 4,293,529 | 10/1981 | Reese | 423/10 |
| 4,316,877 | 2/1982 | Tunick | 423/10 |

FOREIGN PATENT DOCUMENTS

| | | | |
|---|---|---|---|
| 900113 | 7/1962 | United Kingdom | 423/6 |

OTHER PUBLICATIONS

Flett, "Resin Impregnates: The Current Position", *Chemistry and Industry,* Aug. 6, 1977, pp. 641–646.

A. Warshawsky, *Institute of Mining & Metallurgy,* vol. 83, pp. 101–104 (1974).

F. J. Hurst et al., *Chemical Engineering,* pp. 56–57, (Jan. 3, 1977).

*Primary Examiner*—Brian E. Hearn

*Attorney, Agent, or Firm*—Alan M. Doernberg; Robert A. Harman; Gerhard H. Fuchs

[57] ABSTRACT

Uranium is extracted from phosphoric acid with organophosphorus extractants supported or impregnated on polymeric resins, and especially macroreticular resins. Suitable extractants include mono and dialkylphenyl esters of phosphoric acid. Uranium may be stripped from the supported or impregnated resins with hotter or more concentrated phosphoric acid, optionally with oxidation to hexavalent form, or with aqueous fluoride solutions.

5 Claims, No Drawings

EXTRACTION OF URANIUM FROM PHOSPHORIC ACID USING SUPPORTED EXTRACTANTS

BACKGROUND OF THE INVENTION

The present invention relates to the recovery of uranium from phosphoric acid, and especially to the recovery or uranium from aqueous solutions at least 5 molar in phosphoric acid containing uranium at levels of 1 to 500 mg/L.

Uranium is recovered from aqueous solutions in a variety of processes: from solutions present in the milling of conventional ores, from streams present in the reprocessing of spent fuel and from streams present in the manufacture of phosphoric acid and/or phosphates from phosphatic rock. The last of these applications differs from the other two in that concentrated phosphoric acid 5 molar or more is a strong chelating agent for uranium that retains uranium strongly in the aqueous phase and resists its removal therefrom either into an organic phase or onto a solid phase. This effect increases with increasing phosphoric acid concentration and increasing temperature.

Liquid-liquid extraction processes for removing uranium from concentrated phosphoric acid to an organic phase have been proposed utilizing a variety of organophosphorus extractants in the organic phase to effect a partitioning of the uranium between the two phases. Among the conventional extractants proposed are mono- and di-alkylphenyl esters of phosphoric acid such as mono- and di-octylphenylphosphoric acid (OPAP) (to extract tetravalent uranium) and dialkylphosphoric acids such as di-2-ethylhexylphosphoric acid (D2EHPA) (to extract hexavalent uranium). In the latter case, trialkylphosphine oxides such as trioctyl phosphine oxide (TOPO) are generally used as synergists. A third extractant suggested is a pyrophosphate ester, for extracting tetravalent uranium.

In U.S. patent application Ser. No. 096,853, filed Nov. 23, 1979, of Tunick, Largman and Sifniades, a fourth type of extractant is disclosed, being a mixture of organophosphorus compounds formed by reacting a carboxylic acid of 8–18 carbons with $PCl_3$ in the presence of water or by reacting the corresponding acid chloride or anhydride with phosphorous acid. Two active components which are generally present in such extractants are alkane-1,1,2-triphosphonic acid and alkane-1-hydroxy-1,1-diphosphonic acids.

Removal of uranium from aqueous solutions by adsorption onto polymeric solids has been proposed for uses associated with milling of conventional ores and reprocessing of spent fuel. Polymeric solids have not been proposed which are both resistant to concentrated phosphoric acid and of sufficient attractive force with respect to uranium to overcome the chelating effect of concentrated phosphoric acid.

BRIEF DESCRIPTION OF THE INVENTION

It has been discovered that some, but not all, organophosphorus extractants can be supported on polymeric materials which are resistant to phosphoric acid and are of high surface area, and the combination used to extract uranium from phosphoric acid onto the polymeric support. Accordingly, the present invention includes a process which comprises contacting aqueous phosphoric acid of at least 5 molar concentration and containing 1 to 500 ml/L uranium with a polymeric material resistant to phosphoric acid and of high surface area on which is supported an organophosphorus extractant selected from the group consisting of:

(a) mono and dialkylphenyl esters of phosphoric acid,
(b) the product of reacting a carboxylic acid of 8–18 carbons with $PCl_3$ in the presence of water,
(c) the product of reacting a carboxylic acid chloride or anhydride of 8–18 carbons with phosphorous acid,
(d) alkane-1,1,2-triphosphonic acids,
(e) alkane-1-hydroxy-1,1-diphosphonic acids, and,
(f) mixtures thereof under conditions sufficient to extract uranium from the aqueous phosphoric acid onto the polymeric material.

DETAILED DESCRIPTION OF THE INVENTION

The present invention employs certain strong organic chelating agents supported on polymeric materials such as macroreticular resins to extract uranium from phosphoric acid of at least 5 molar concentration. By contrast, weaker organophosphorus extractants such as D2EHPA, even if combined with a synergist such as TOPO, are relatively ineffective when supported on polymeric materials to extract uranium from such phosphoric acid. An article by A. Warshawsky in Institution of Mining & Metallurgy, vol. 83, pp. C101–04 (1974) discloses D2EHPA supported in Amberlite® XAD-2 macroreticular resin used to extract zinc from aqueous zinc chloride.

One group of organophosphorus extractants useful in the present invention are the mono- and dialkylphenyl esters of phosphoric acid, preferably being mixtures of the two. Such extractants can be characterized by the formulae

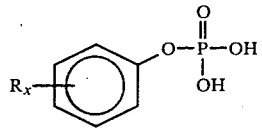

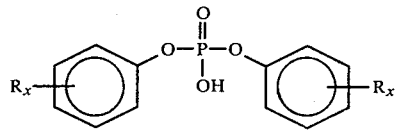

with R being alkyl of 4–14 carbons and x being 1, 2 or 3. The most preferred extractant of this type, OPAP, is a mixture of compounds of the two formulae with R being n-octyl and x being 1 in all occurrences. When these extractants are used, the uranium should be predominantly in the tetravalent form and any iron should be substantially all in the divalent form.

A second group of organophosphorus extractants useful in the present invention are the phosphoric acid type extractants described in Ser. No. 096,853. These include the products of reacting a carboxylic acid of 8–18 carbons with $PCl_3$ in the presence of water (or with water added to complete the reaction). The equivalent reaction of the corresponding acid chloride or anhydride with phosphorous acid may also be employed. These reactions generally produce a mixture of organophosphorus compounds as the product, as described in Ser. No. 096,853. One significant component of the product mixture is an alkane-1,1,2-triphosphonic acid if the reaction temperature is about 150° C. One significant component of the product mixture is an alkane-1-hydroxy-1,1-diphosphonic acid when the reaction temperature is about 110° C. These compounds are not usually present together in the reaction mixture as major components except, perhaps, at intermediate temperatures. Each of these components are effective alone, as well as in the product mixtures. They can be characterized by the formulae

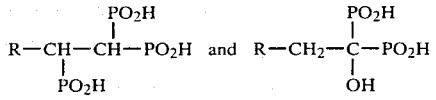

where the starting material is $R—CH_2—COOH$, $R—CH_2COCl$ or $R—CH_2—CO—O—OC—CH_2—R$, with R being alkyl of 6–16 carbons. Preferably, R is of 7–13 carbons, such that the products and organic reactants are of 9–15 carbons (except that anhydrides would be of 18–30 carbons).

While the organophosphorus extractants may be supported on any polymeric surface, it is preferred to have macroreticular resins and especially macroreticular resins which are polyacrylates or styrene-vinyl benzene copolymers. Such resins are described in some detail in U.S. Pat. Nos. 3,531,463 (Sept. 29, 1970 to Gustafson) and 3,663,467 (May 16, 1972 to Albright) and are commercially available from Rohm and Haas under their AMBERLITE registered trademark. Other suitable resin supports include polyvinyl chloride, ABS, and polysulfone.

The preferred method of supporting the organophosphorus extractants on the resins is to dissolve the extractants in an organic solvent, e.g. kerosene, similar hydrocarbons, chloroform, methylene chloride or similar chlorinated hydrocarbons, and then impregnate the resin. Solvent may be, but need not be, removed by evaporation before use. Once the organophosphorus extractants are impregnated on the resin, the resins may be used in the normal manner in which ion exchange resins are used. Thus, the phosphoric acid containing uranium may be passed through a bed of the impregnated resin or mixed with impregnated resin in a mixing vessel and then separated by centrifugation or filtration. The use of a column is preferred, with the flow continued until appreciable uranium appears in the effluent. The phosphoric acid is preferably of reduced form, especially if alkylphenyl phosphate extractants are used. The temperature of absorption is preferably 10°–80° C., with temperatures below 60° C. preferred when alkylphenyl phosphate extractants are used. Suitable contact times long enough not to have appreciable uranium in the initial effluent can be determined by routine experimentation.

Impregnated resin loaded with uranium can be washed with water, air or another inert stream to remove the major portion of the feed used and then stripped with a solution having a stronger chelating effect for uranium than the organophosphorus extractant or having ingredients which transform the uranium into a form not tightly held by the resin. For example, hotter and more concentrated phosphoric acid may be used, especially with alkylphenyl phosphate extractants. An oxidant may be present which oxidizes the uranium to the hexavalent state which the alkylphenyl phosphates do not retain as strongly as tetravalent uranium. Alternatively, a fluoride solution such as aqueous HF or aqueous ammonium bifluoride may be used to convert the uranium to a fluoride form, which is released by the organophosphorus extractant. If fluorides are used, the resin, container walls and other equipment must be chosen so as not to corrode or degrade under fluoride treatment, with HF generally being a better stripper, but more corrosive than ammonium bifluoride. A wash with water or the like may precede the next loading step with feed acid.

If, as described in the examples, silica builds up on the impregnated resin, HF or ammonium bifluoride may be use to remove the silica as fluorided silica or silicon tetrafluoride (a gas). If a fluoride solution is not used in each cycle for stripping, then a separate fluoride treatment (e.g. 5–10% aqueous HF) may be employed periodically after several to several hundred cycles whenever silica build up is detected by shortened loading times to breakthrough. If the equipment is not compatible with the fluoride solution, then the separate fluoride treatment may be conducted in separate equipment, with the regenerated resin returned to the main equipment before resuming loading. Periodic reimpregnation of the resin with organophosphorus extractant may be performed at similar intervals or less frequently.

EXAMPLE 1

Bead preparation: a 500 mL round bottom flask was charged with 50 mL (15 g) of dry AMBERLITE XAD-7 resin 20–50 mesh ("AMBERLITE" being a registered trademark of Rohm and Haas Company) along with a solution of OPAP (15 g) and kerosene (15 g) in 100 g of methylene chloride. The flask was attached to a rotary flask evaporator and the methylene chloride was gently removed; final weight of resin, 45 g; volume, 75 mL.

A jacketed glass column 1.5 (inside diameter) cm × 46 cm of the type used in high pressure liquid chromatography was charged with 70 mL of the resin beads. The temperature of the column was maintained at 40° C. by means of a circulating constant temperature bath. A 5.5 M phosphoric acid solution containing 150 mg/L $U^{4+}$ and 2 g/L of dissolved iron powder was pumped upward through the resin bed at the rate of 2 mL/min. The eluant was divided into 20 mL aliquots by means of a fraction cutter and the concentration of uranium in the fractions was monitored by recognized analytical techniques. 3.45 L of standard solution (49 bed volumes) was passed through the column before a 10% breakthrough 16 mg/L U was found in the eluant. After loading the column with 585 mg of uranium, the column temperature was raised to 60° C. and 10 M phosphoric acid was pumped upward at the rate of 0.5 mL/min. Ninety-five percent of the uranium in the column could be recovered after passage of 80 mL of 10 M phosphoric acid. One fraction obtained during elution contained 19,718 mg/L U.

EXAMPLE 2

Synthesis of Extractant

Lauric acid, 3606 g, was placed in a pot and mixed at 50° C. with water, 324 mL. To the stirred mixture was added within 45 min. phosphorus trichloride, 1040 mL, maintaining temperature at 40°–65° C. The mixture was heated to 150° C. and maintained at that temperature for 5 h, then it was cooled to 65° C. and ethanol, 1260 mL, was added. After stirring for several hours at room temperature, the clear solution was passed through a wiped film evaporator at 150° C., 4 torr or 530 Pa pressure. The residue from the evaporator was passed once more through the evaporator at 150° C., 0.9 torr or 120 Pa pressure. The final residue, 2100 g, was dissolved in an equal weight of dibutyl butyl phosphonate.

Solvent Impregnated Resin

A portion of the extractant is mixed with some chloroform and blended with an equal weight of a macroporous resin. After evaporation of the chloroform, a free flowing resin is obtained, which is packed in a vertical jacketed column constructed of a clear or translucent plastic impervious to phosphoric acid or hydrogen fluoride.

Column Operation

Technical phosphoric acid, about 10 molar, containing 200 mg uranium per liter, is fed upwards through the column. The resin has a lower density than the phosphoric acid and forms a well-packed bed at the upper portion of the column. The uranium content of the exit stream is initially very low (<2 mg/L), but it gradually increases and, after several bed volumes of feed have passed through the column, it reaches the content of the feed stream. At that point the column is drained of liquid by flowing air through it and aqueous hydrogen fluoride, about 45% HF, is fed through the top of the column. The density of the resin is lower than that of the hydrogen fluoride and feeding hydrogen fluoride downwards causes the resin bed to expand. Flow is adjusted so that the bed expands 10–50%. The hydrogen fluoride removes uranium from the resin and forms a fine precipitate containing a mixture of uranium fluorides. It also removes various silicate salts that may have deposited on the resin during the passage of technical phosphoric acid. The exit hydrogen fluoride stream is subjected to centrifugation in order to remove the uranium containing precipitate and is then recycled to the column. This operation continues until no more precipitate forms. The column is then drained by blowing air through it and is ready for the next cycle.

Optionally, a small amount of water may be fed to the column either instead of or in conjunction with drainage in order to remove phosphoric acid or hydrogen fluoride from the column.

EXAMPLE 3

The loading step of Example 1 was repeated using each of the AMBERLITE resin beads indicated in Table I in place of the AMBERLITE XAD-7 polyacrylate beads. The bed values to breakthrough (over 5 ppm U) is indicated in Table. I.

TABLE I

| Resin | Extractant | B.V. to Breakthrough |
|---|---|---|
| XAD-4[a] | Decyl pyrophosphate | <3 |
| XE-299[b] | OPAP | <6 |
| XAD-8[c] | D2EHPA/TOPO | <1 |
| XE-299[b] | D2EHPA/TOPO | 4 |

[a]Rohm & Haas styrene-divinyl benzene copolymer macroreticular resin
[b]Rohm & Haas macroreticular weak base resin with styrene-divinyl benzene matrix
[c]Rohm & Haas acrylic acid ester macroreticular resin.

EXAMPLE 4

The loading step of Example 1 was repeated using phosphoric acid containing controlled amounts of iron (II) and iron (III). While up to 7 g/L of iron (II) had no significant deleterious effect, the breakthrough point dropped from about 17 bed volumes with 1 g/L iron (III) to about 1 bed volume with 5 g/L iron (III).

EXAMPLE 5

A 0.5 inch inside diameter column was loaded with 75 mL (47.71 g) the Amberlite XAD-7: kerosene: OPAP mixture of Example 1 and equilibrated with 5.5 M technical grade phosphoric acid. Then 5.5 M reduced commercial phosphoric containing 115 mg/L uranium and 8.2 g/L iron was passed at 50° C. upward through the column at 3 mL/min. until 1.4 L of feed solution had passed through the column. The temperature was then raised to 70° C. and 10 M technical grade phosphoric acid was passed upward at a flow rate of 0.5 mL/min. The entire cycle was then repeated, with all effluents taken as 5–20 mL cuts and selected cuts analyzed for uranium and, in some cases, iron. The effluent amount (in bed volumes) during each loading cycle before breakthrough (over 5 mg/L U) observed was as follows for the first six cycles:

| Cycle | B.V. to Breakthrough |
|---|---|
| 1 | 13.6 |
| 2 | 10.7 |
| 3 | 10.7 |
| 4 | 10.1 |
| 5 | 8.5 |
| 6 | 5.6 |

The effluents from the stripping cycles showed maximum uranium concentrations as high as 20,000 mg/L. Most of the uranium eluted between 0.5 and 2 bed volumes of effluent in a peak of varying height and width. The loss in loading capacity is not believed to be the result of extractant loss because insignificant amounts of OPAP appeared in the effluents by high pressure liquid chromatography. Examination of the beads after prolonged recycling by Electron Spectroscopy for Chemical Applications (ESCA) indicated a substantial silica concentration on the surface. It would be possible to remove this silica by periodic treatments with aqueous HF after a stripping cycle. It is believed that such a step would regenerate the system for renewed extraction.

We claim:

1. A process which comprises contacting aqueous phosphoric acid of between about 5 and about 8 molar concentration and containing 1 to 500 mg/L uranium with a polyacrylate macroreticular resin resistant to phosphoric acid and of high surface area on which is supported an organophosphorus extractant selected from the group consisting of mono and dialkylphenyl esters of phosphoric acid;

uranium in the aqueous phosphoric acid being predominantly in tetravalent form and any iron in the aqueous phosphoric acid being substantially all in the divalent form.

2. The process of claim 1 wherein uranium is stripped from the polymeric material with at least about 8 molar aqueous phosphoric acid.

3. The process of claim 2 wherein the at least about 8 molar aqueous phosphoric acid contains an oxidant and the uranium is stripped predominantly in hexavalent form.

4. The process of claim 1 further comprising stripping absorbed uranium from the polymeric material with a liquid containing an oxidant.

5. The process of claim 1 wherein the extractant has been dissolved in a hydrocarbon solvent and the resultant solution has been impregnated on the macroreticular polyacrylate support.

* * * * *